US010343883B2

(12) United States Patent
Haunold et al.

(10) Patent No.: US 10,343,883 B2
(45) Date of Patent: Jul. 9, 2019

(54) LIFTING DEVICE OF AN INDUSTRIAL TRUCK AND METHOD FOR SETTING DOWN A LOAD CARRIED ON LOAD HANDLING MEANS OF AN INDUSTRIAL TRUCK ON A SURFACE

(71) Applicant: Linde Material Handling GmbH, Aschaffenburg (DE)

(72) Inventors: Matthias Haunold, Gelnhausen (DE); Christoph Lange, Obernburg (DE); Stefan Habenicht, Dieburg (DE)

(73) Assignee: LINDE MATERIAL HANDLING GMBH, Aschaffenburg (DE)

( * ) Notice: Subject to any disclaimer, the term of this patent is extended or adjusted under 35 U.S.C. 154(b) by 334 days.

(21) Appl. No.: 15/348,597

(22) Filed: Nov. 10, 2016

(65) Prior Publication Data

US 2017/0129757 A1 May 11, 2017

(30) Foreign Application Priority Data

Nov. 11, 2015 (DE) ..... 10 2015 119463

(51) Int. Cl.
*B66F 9/22* (2006.01)
*B66F 9/24* (2006.01)
*B66F 17/00* (2006.01)

(52) U.S. Cl.
CPC ..... *B66F 17/003* (2013.01); *B66F 9/22* (2013.01); *B66F 9/24* (2013.01)

(58) Field of Classification Search
CPC ..... B66F 9/22; B66F 9/24; B66F 17/003
See application file for complete search history.

(56) References Cited

U.S. PATENT DOCUMENTS 4,762,203 A 8/1988 Ryan
4,955,461 A 9/1990 Keir
6,431,816 B1 8/2002 Jordan et al.

FOREIGN PATENT DOCUMENTS

DE 102012101734 A1 9/2013
EP 1657031 A1 5/2006

*Primary Examiner* — Diem M Tran
(74) *Attorney, Agent, or Firm* — The Webb Law Firm

(57) ABSTRACT

A lifting device of an industrial truck includes a load handling arrangement that is raised and lowered on a lifting frame and a hydraulic lift cylinder device that is actuated by an electrically actuatable control valve device, in which an electronic control device is provided to actuate the control valve device. The electronic control device has an automated set-down mode actuated during a lowering of the load handling arrangement. The load is lowered at a lowering speed specified by a deflection of a control element to the designated surface. As the control element continues to be deflected into the lowering position, the lowering of the load handling arrangement is terminated by the electronic control device by actuating the control valve device into a shut-off position to prevent the load handling arrangement from being set down on the designated surface.

17 Claims, 3 Drawing Sheets

LIFTING DEVICE OF AN INDUSTRIAL TRUCK AND METHOD FOR SETTING DOWN A LOAD CARRIED ON LOAD HANDLING MEANS OF AN INDUSTRIAL TRUCK ON A SURFACE

CROSS REFERENCE TO RELATED APPLICATION

This application claims priority to German Patent Application No. 10 2015 119 463.5, filed on Nov. 11, 2015, the disclosure of which is hereby incorporated by reference in its entirety.

BACKGROUND OF THE INVENTION

Field of the Invention

This invention relates to a lifting device of an industrial truck with a load handling arrangement located on a lifting frame so that the load handling arrangement can be raised and lowered, in which, to raise and lower the load handling arrangement, a hydraulic lift cylinder device is provided that can be actuated by an electrically actuatable control valve device, in which an electronic control device that controls the control valve device is provided.

The invention further relates to a method for setting down a load carried on a load handling arrangement of an industrial truck on a surface, in which the load handling arrangement is located so that the load handling arrangement can be raised and lowered on a lifting frame of the industrial truck, and, to raise and lower the load handling arrangement, a hydraulic lift cylinder device is provided that can be actuated by an electrically actuatable control valve device, in which the control valve device is actuated into a lowered position as a function of the deflection of a control element.

Description of Related Art

Industrial trucks are used for the handling of loads with load handling means that are formed by a load carriage that can be raised and lowered on the lifting frame and an attachment that is fastened to it. The attachment can be, for example, a load fork consisting of fork tips which can be run underneath a load such as a pallet. The attachment can also be a clamping device, such as a baling or roll clamp with which a load is held by lateral clamping. Flexible traction means such as a load chain, for example, are fastened on the load carriage to raise and lower the load handling means and are fastened by the first end to the load carriage, guided around a return pulley and fastened by a second end to the lifting frame. The traction means are actuated by a lift cylinder device, which generally includes one or more lift cylinders, each with a telescoping piston rod.

As the load handling means are lowered during a lowering process, under some operating conditions the descending movement of the load handling means can be stopped and the piston rod of the lift cylinder device can be retracted further. In this case, the traction means go slack, so that, after the load handling means are released, there is a sudden and jerky descending movement of the load handling means until the traction means are once again taut. This can cause damage to the load being handled and/or an overloading of the traction means.

Operating conditions of this type can occur, for example, when a load is being set down by load handling means in the form of a load fork on a shelf compartment if the load tips of the load fork, as the load is being set down in the shelf compartment, are in contact with the shelf compartment when the lift cylinder device is driven in further and, therefore, the traction means are slack and lose tension. As soon as the load tips become free again as they are pulled out of the shelf compartment, there is an undesirable sudden descending movement of the load fork, until the traction means are once again taut.

An additional operating situation of this type occurs if, during the lowering of the load by load handling means in the form of a clamp device, the load held by the clamp device is sitting on the floor or in a shelf compartment and is in contact with the floor or the shelf compartment. If the descending movement of the lift cylinder device continues to be actuated, the clamping device is held in position by the load, so that the traction means connected with the load carriage as a result of the further driving-in motion of the piston rod of the lift cylinder device go slack and lose tension. If the clamping device is then opened, the clamping device fastened to the load carriage descends suddenly until the traction means are again taut. This can result in damage to the load as well as an overloading of the traction means.

To prevent the sudden uncontrolled descent of the load handling means when the traction means go slack, it is already known that a hydraulic load protection function can be provided.

This hydraulic load protection function includes a dump valve in the form of a mechanical check valve, which is located in a connecting line between the control valve device and the lift cylinder device parallel to a check valve that opens toward the lift cylinder device. The dump valve is actuated by a spring into a closed position and is held open by pressure present in the connecting line. As soon as, during a lowering process, the pressure present in the connecting line is less than the spring bias of the spring, which acts as a pressure threshold, e.g. during the un-loading of the load handling means, the dump valve is actuated into the closed position and the connecting line is shut off so that the descending movement and thus the lowering of the load handling means stops abruptly. The purpose of this hydraulic load protection function is to prevent the traction means from going slack while setting down a load on the intended surface with a heavy attachment. A lifting device with a dump valve of this type in the connecting line to keep the traction means taut is illustrated in FIG. 6 in U.S. Pat. No. 4,955,461 A1. The pressure threshold of the dump valve, which is mechanically specified and set by the spring, equals the pressure in the connecting line that occurs when the load handling means are not loaded. With an attachment in the form of a baling or roller clamp as the load handling means, with which rolls of paper are handled, a dump valve of this type can prevent the destruction of the rolls of paper being carried when the roll of paper is set down in the designated location.

However, this load protection function can be realized with a dump valve only if a sufficiently heavy attachment is present to handle the load as load handling means, which, in the raised position, generates a sufficiently high pressure in the connecting line, for example if the weight of the attachment is greater than 500 kg, and if, when the load is being set down, it is clamped shut and therefore the load is held in place by clamps, so that a pressure of approximately 0 bars results in the connecting line when the load is set down on the designated surface. This occurs because the attachment must generate a sufficiently high pressure to place the pressure threshold of the dump valve far from the pressure that occurs during the raising of the lifting device without the attachment, i.e. the pressure during the raising of the elevatable parts of the mast of the lifting frame, to prevent a lowering of the attachment even at low pressures with an actuation of the dump valve connected with an abrupt stop in the downward movement during operation.

DE 10 2012 101 734 A1 describes a lifting device of an industrial truck, with which the load protection function described above that prevents the traction means from going slack when a load is set down on a designated surface, is achieved electronically. The pressure in the connecting line between the control valve device and the lift cylinder device is measured by means of a pressure sensor and, during the lowering of the load handling means, the control valve device is actuated into a closed position to stop the descent if the pressure in the connecting line is below a pressure limit value. The pressure limiting value is slightly below the pressure that corresponds to the empty load handling means, i.e. when no load is present. The pressure limiting value is therefore selected so that it is slightly lower than the pressure that occurs during the lowering of the load handling means without a load. With a pressure limit value of this type, the insertion movement of the lift cylinder device is terminated by a corresponding actuation of the control valve device into the closed position and the traction means are prevented from going slack, as soon as the load handling means, or a load clamped by the load handling means, are in contact with the surface on which they are to be set down and the load handling means have terminated their descending movement.

One disadvantage of lifting devices of this type, however, is that when a load is being carried freely, for example a pallet being supported by a load fork as the load handling means, the descending movement is stopped only if the load handling means are in contact with the surface on which the load is to be deposited, i.e. the load handling means have terminated their descending movement. If an operator wants to drive away with the load handling means from the surface on which the load was deposited, the operator must therefore raise the load handling means slightly from the surface on which the load was deposited and, therefore, readjust the load handling means after the load has been set down on the surface where it was deposited to prevent the load handling means from scraping the surface as the industrial truck is driven away. The readjustment of the height of the load handling means, however, requires a complex maneuver on the part of the operator as the load is being set down on the designated surface and can result in the scraping of the load handling means on the surface as the industrial truck is driven away from the surface where the load has been set down, with corresponding wear of the load handling means.

SUMMARY OF THE INVENTION

The object of the present invention is to make available a lifting device of the type described above with which the sequence of operations for the operator, as a load is being set down on a designated surface, can be simplified and wear on the load handling means can be reduced.

This object is accomplished by the invention in that the electronic control device has an automated set-down mode in which, during the lowering process of the load handling means to set down a load being carried on the load handling means on a designated surface, in which the control valve device is actuated into a lowering position as a function of the deflection of a control element into a lowering position, the load is lowered to the surface on which it is to be set down at the lowering speed specified by the deflection of the control element. With the control element continuing to be deflected into the lowering position, by the actuation of the control valve device into a shut-off position by the electronic control device, the lowering process of the load handling means is terminated so that the load handling means are prevented from being set down on the surface on which the load is to be set down. With the automated set-down mode, therefore, during a lowering of the load handling means with which a load carried on the load handling means is set down on a designated surface, the lowering movement of the load handling means is automatically stopped and thus the lowering of the load handling means is automatically terminated before the load handling means is set down on the surface on which the load is being set down. With the automated stop in the descent of the load handling means in the automated set-down mode according to the invention, the sequence of control operations of the industrial truck is simplified because no readjustment of the height of the load handling means is necessary, so that the vehicle can be driven away from the surface in which the load has been set down without scraping the load handling means. With the stopping of the descent of the load handling means by the automated set-down mode according to the invention, the wear on the load handling means is also reduced, because the load handling means is not dragged along the surface where the load has been deposited as the industrial truck is driven away.

In one preferred embodiment of the invention, a pressure sensor device is provided that measures the pressure in a connecting line that runs from the control valve device to the lift cylinder device, in which the pressure sensor device is in communication with the electronic control device that actuates the control valve device. The pressure is measured by the pressure sensor device in the automated set-down mode during the lowering process of the load handling means, and the lowering process of the load handling means is terminated by an actuation of the control valve device into the shut-off position when the pressure measured by the pressure sensor device is below a specified pressure limiting value. The pressure limiting value is set between an unloaded pressure that results when the load handling means are not carrying any load and a minimum pressure that results when the load handling means are carrying a minimum load. The selection of the pressure limiting value between the unloaded pressure that results when the load handling means are not carrying any load and a minimum pressure that results when the load handling means are carrying a minimum load, makes it possible, during the lowering of the load handling means, on the basis of the pressure history of the pressure in the connecting line, to determine when the load has been set down on the designated surface so that the lowering of the load handling means can be automatically terminated and, therefore, stopped before the load handling means are set down on the designated surface. This selection of the pressure limiting value therefore means that the load being handled with the load handling means, for example a pallet carried freely by a load fork, is lowered at the lowering speed specified on the control element to the designated surface on which the load is to be set down, and then the load handling means can be stopped before they are set down on the designated surface.

In one development of the invention, it is particularly advantageous if the control valve device in the automated set-down mode is actuated by the electronic control device into the shut-off position so that the lowering speed of the load handling means is reduced, beginning when the measured pressure drops below the pressure limit value and continuing in a linear or exponential fashion to zero at the unloaded pressure. As a result of this actuation of the control valve device, the load being handled by the load handling means, for example a pallet being carried freely by a load fork, at the speed of descent specified on the control element, is set down on the designated surface and then the load handling means are stopped before they are set down on the designated surface.

It is particularly advantageous if, in one development of the invention, the pressure limit value is lower by a margin of safety than a range around the minimum pressure generated by oscillations. It is thereby ensured in a simple manner that the automated set-down mode is not erroneously initiated by the stopping of the descent of the load handling means as a result of dynamic effects in the lowering process of the load handling means, since on account of dynamic effects generated by vibrations, the pressure can fluctuate in a range around the minimum pressure.

In one advantageous development of the invention, the automated set-down mode is activated by the electronic control device if, by means of the pressure sensor device, a pressure is measured that equals at least the minimum pressure. It is thereby ensured that the automated set-down process is then only activated and engaged if a load is actually being set down in a lowering process.

There are additional advantages if, as in one development of the invention, the automated set-down mode is activated by the electronic control device during a lowering process only when the pressure measured by the pressure sensor device falls from the minimum pressure to the pressure limiting value within a specified length of time. If the pressure measured during the lowering process falls from the minimum pressure to the pressure limit value within a specified period of time, it can easily be ensured that the operation in question is the setting-down of a load on a designated surface and one that should be carried out by the automated set-down mode of the descent stop of the load handling means.

In one development of the invention, as a result of an actuation of the control element into the neutral position and subsequent repeated actuation of the control element into the lowering position, a further lowering of the load handling means can be achieved by an actuation of the control valve device into the lowering position. The operator can therefore easily, by an actuation of the control element into the neutral position and subsequent repeated actuation of the control element into the lowering position, perform a further lowering of the load handling means after the load handling means are stopped by the automated set-down mode.

If the lifting frame is in the form of a multi-section lifting frame with at least two lifting stages, there are additional advantages if the electronic control device is in an operative connection with a sensor device, which is used to determine the lifting stage in which the load handling means are currently located. Consequently, regardless of the lift height of the load handling means, the automated set-down mode with the automated descent stop of the load handling means can be used. If different pressures result in the connecting line on account of the raising of different mast parts of the lifting frame during the lifting stages, different pressure limiting values can be stored in the electronic control device for the corresponding lifting stages, which are then selected as a function of the signal from the sensor device.

In one development of the invention, the unloaded pressure and/or the minimum pressure and/or the pressure limiting value can be adjusted and varied. By setting the unloaded pressure, the automated set-down mode can be easily adapted to the weight of the load handling means or of the attachment. By setting the minimum pressure and the pressure limit value, the automated set-down mode can be easily adapted to the operating conditions of the industrial truck.

In one exemplary embodiment of the invention, the control valve device is in the form of a control valve with a lowering position and a shut-off position, which can be actuated by means of an electronic actuator device toward the lowering position. The control valve device may include separate control valves for the raising and lowering of the load handling means that are in communication with the electronic control device for their actuation. With the control valve for the lowering, the lowering movement of the load handling means can be stopped during a lowering by an appropriate actuation into the shut-off position.

In one preferred embodiment of the invention, the control valve device is a control valve with a raising position, a lowering position, and a shut-off position in the form of a neutral position which can be actuated by means of an electrical actuator device toward the lowering position and by means of an additional actuator device toward the raising position. With a control valve of this type, which can be in the form of a directional valve that throttles in intermediate positions, it is easily possible, by actuating the control valve into the neutral position during lowering, to stop the descending movement of the load handling means.

For the actuation of the control valve device into the neutral position when the pressure in the connecting line drops below the pressure limiting value, it is particularly advantageous if the electronic control device terminates the actuation of the control valve device into the lowering position. As a result of a termination of the actuation of the electric actuator device that actuates the control valve device into the lowering position, an actuation of the currentless control valve device into the shut-off position is achieved, and thus the descending movement of the load handling means is stopped.

The object of the invention is also accomplished by a method in which the load is lowered to the surface on which it is to be set down at the lowering speed specified by the deflection of the control element, and, with the control element continuing to be deflected into the lowering position, the lowering process of the load handling means is terminated as a result of the actuation of the control valve device into a shut-off position so that the load handling means are prevented from being set down on the surface where the load is to be set down. With the method according to the invention, which forms an automated set-down mode of the load on a designated surface during a lowering process of the load handling means, in which a load carried on the load handling means is set down on a designated surface, the lowering of the load handling means is automatically stopped and the lowering of the load handling means is automatically terminated before the load handling means are set down on the designated surface. With the automated stopping of the lowering of the load handling means in the automated set-down mode, the sequence of control operations of the industrial truck is simplified, because no readjustment of the height of the load handling means is necessary to be able to drive the truck away from the designated surface on which a load has been set down without scraping the load handling means. The stopping of the lowering of the load handling means in the automated set-down mode according to the invention also reduces wear on the load handling means, because as the truck is driven away from the designated surface on which the load has been set down, the scraping of the load handling means on the surface is prevented.

In one development of the invention, as the load carried on the load handling means of the industrial truck is set down on the designated surface, the pressure in a connecting line that runs from the control valve device to the lift cylinder device is continuously measured and the lowering process of the load handling means is terminated by an actuation of the control valve device into the shut-off position when the pressure detected drops below a specified pressure limiting value. The pressure limiting value lies between an unloaded pressure that results when the load handling means are not carrying any load and a minimum pressure that results when the load handling means are carrying a minimum load. The selection of the pressure limiting value between the unloaded pressure that results when the load handling means are not carrying a load and a minimum pressure that results when the load handling means are carrying a minimum load makes it possible, during the lowering of the load handling means, to determine on the basis of the pressure history of the pressure in the connecting line and by the evaluation of the pressure history of the pressure in the connecting line, when the load has been set down on the designated surface so that the descent of the load handling means is automatically terminated and can thus be stopped before the load handling means are set down on the designated surface. As a result of this selection of the pressure limiting value, the load being handled with the load handling means, such as a pallet freely carried by a load fork, for example, is lowered to the designated surface on which it is to be set down at the speed of descent specified on the control element and the load handling means can then be stopped before they are set down on the designated surface.

It is particularly advantageous if, as in one development of the invention, the control valve device is actuated into the shut-off position as the load carried on the load handling means of the industrial truck is set down on the designated surface, so that the speed of descent (lowering speed) of the load handling means is reduced to zero in a linear or exponential fashion beginning when the pressure drops below the pressure limit value until it reaches the unloaded pressure. As a result of this actuation of the control valve device, the load being handled by the load handling means, such as a pallet freely carried by a load fork, is lowered to the designated surface at the lowering speed specified on the control element and the load handling means is then stopped before being set down on the designated surface.

It is particularly advantageous if, as in an additional exemplary embodiment of the invention, the pressure limiting value is lower by a safety margin than a range generated by oscillations around the minimum pressure. As a result, it can be insured in a simple manner that the automated set-down mode with the stop in the descent of the load handling means is not erroneously initiated by dynamic effects in the lowering process of the load handling means, since on account of these dynamic effects, the pressure can fluctuate in a range generated by oscillations around the minimum pressure.

In one advantageous development of the invention, the setting down of the load carried on the load handling means of the industrial truck on the designated surface with the automated stopping of the descent of the load handling means is activated only if a pressure is measured that at least equals the minimum pressure. It is thereby ensured that the automated set-down mode with the automated stopping of the lowering of the load handling means is activated and engaged only if the load is actually being set down.

Additional advantages can be achieved if, as in one development of the invention, during the lowering process, the setting down of the load carried on load handling means of the industrial truck on the designated surface with the automated stopping of the lowering of the load handling means is activated only if the pressure drops from the minimum pressure to the pressure limiting value within a specified period of time. If, during the lowering process, the pressure in the connecting line drops from the minimum pressure to the pressure limiting value within a specified period of time, it can easily be ensured that it is an actual process of setting down a load on a designated surface and that the descent of the load handling means should be stopped by the automated set-down mode.

In one development of the invention, a further lowering of the load handling means is achieved by an actuation of the control element into the neutral position and a subsequent repeated actuation of the control element into the lowering position. The operator, by actuating the control element into the neutral position followed by a repeated actuation of the control element into the lowering position, can therefore easily perform a further lowering of the load handling means after the load handling means has been stopped by the automated set-down mode.

If the lifting frame is in the form of a multi-section lifting frame with at least two lifting stages, there are additional advantages if a sensor device is used to determine in which lifting stage the load handling means is currently located. As a result, regardless of the lift height of the load handling means, the automated set-down mode with the automated stopping of the lowering of the load handling means can be used. If different pressures in the connecting line are present in the lifting stages because different parts of the lifting mast are raised, different pressure limiting values can be stored in the electronic control device for the corresponding lifting stages, and the appropriate signal from the sensor device can then be selected.

In one development of the invention, the unloaded pressure and/or the minimum pressure and/or the pressure limit value can be set and varied. By setting the unloaded pressure, the automated set-down mode can easily be adapted to the weight of the load handling means or of the attachment. By setting the minimum pressure and the pressure limit value, the automated set-down mode can easily be adapted to the operating conditions of the industrial truck.

BRIEF DESCRIPTION OF THE DRAWINGS

Additional advantages and features of the invention are explained in greater detail below, with reference to the exemplary embodiment illustrated in the accompanying figures, in which.

DESCRIPTION OF THE DISCLOSURE

Figure 1:
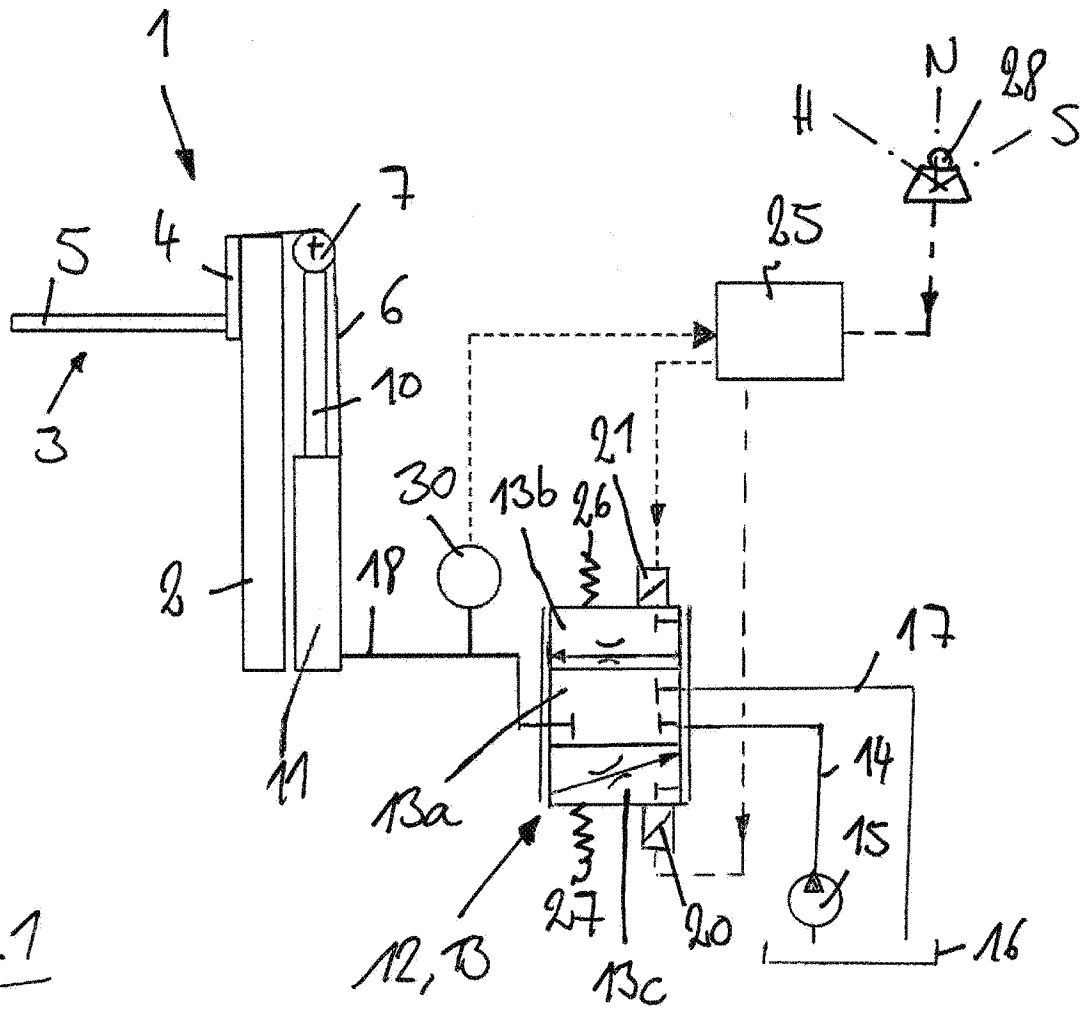
FIG. 1 is a schematic illustration of a lifting device according to the invention.

FIG. 1 is a schematic illustration of a lifting device 1 according to the invention of an industrial truck that is not illustrated in any further detail.

The lifting device 1 includes a lifting frame 2 on which load handling means 3 (also referred to as a load handling arrangement) is located so that it can be raised and lowered. In the illustrated exemplary embodiment, the load handling means 3 includes a lifting carriage 4 that can move vertically in the load frame 2 and to which a load fork 5 formed by fork tips is attached. The load fork 5 has two fork tips. With a load fork 5 of this type, the load fork 5 can be run under a pallet with a load carried on it and the pallet can be carried freely.

A lift cylinder of a hydraulic lift cylinder device 11 is provided to raise and lower the load handling means 3.

In the illustrated exemplary embodiment, the lift cylinder device 11 is connected with the load handling means 3 by means of flexible traction means 6 such as a lifting chain. For this purpose, the traction means 6 are fastened by a first end to the lifting carriage 4. The traction means 6 are guided over a return pulley 7 and are fastened by a second end to the lifting frame 2 or to the chassis of the industrial truck.

In the illustrated exemplary embodiment, the return pulley 7 is located on a telescoping piston rod 10 of the lift cylinder of the hydraulic lift cylinder device 11.

The lift cylinder device 11 can be actuated by means of a control valve device 12 to raise and lower the load handling means 3. In the illustrated exemplary embodiment, the control valve device 12 is in the form of a control valve 13 that acts as a throttle in intermediate positions with a shut-off position in the form of a neutral position 13*a*, a raising position 13*b*, and a lowering position 13*c*. For this purpose, the control valve 13 is connected to a connecting line 14 of a pump 15, a reservoir line 17 that leads to a reservoir 16, and a connecting line 18 that leads to the lift cylinder device 11. The connecting line 18 forms a supply line of the lift cylinder device 11 to which other lift cylinders, not shown in any further detail, of the lift cylinder device 11 can be connected.

In the shut-off position 13*a* of the control valve device 12, the connection of the connecting line 18 with the connecting line 14 and the reservoir line 17 is shut off. In the raising position 13*b* of the control valve device 12, the connecting line 14 is connected with the connecting line 18. In the lowering position 13*c* of the control valve device 12, the connecting line 18 is in communication with the reservoir line 17.

The control valve device 12 can be actuated electrically. For this purpose, an electrical actuator device 20 is provided which, when actuated, actuates the control valve device 12 toward the lowering position 13*c*. By means of an additional electric actuator device 21, the control valve 12 can be actuated toward the raising position 13*b*. The actuator devices 20, 21 can be magnets, in particular proportional magnets.

For the actuation of the control valve device 12, an electronic control device 25 is provided which is in communication with the actuator devices 20, 21.

By means of a spring device formed by two springs 26, 27, the control valve device 12 is actuated in the unactuated and currentless state into the shut-off position 13*a*, which is in the form of a neutral position.

The electronic control device 25 is in communication on the input side with an operator-actuated control element 28 such as a joystick, for example, the actuation of which can initiate a lifting process or a lowering process of the load handling means 3. The control element 28 can be actuated from a neutral position N by an operator of the industrial truck into a lowering position S and a raising position H. The lowering speed of the load handling means 3 is set by the operator by deflecting the control element 28 into the lowering position S. By means of the electronic control device 25, in response to a corresponding actuation of the actuator device 20, the control valve device 12 is moved toward the lowering position 13*c* to achieve the specified lowering speed of the load handling means 3.

The pressure present in the connecting line 18 can be measured by a pressure sensor device 30 that is in communication with the electronic control device 25.

According to the invention, the electronic control device 25 is provided with an automated set-down mode with which a load carried on the load handling means 3 can be set down on a designated surface AF and an automated stopping of the lowering of the load handling means 3 achieved.

The automated set-down mode according to the invention is explained below with reference to the accompanying FIGS. 2(*a*), 2(*b*), and 3.

Figure 3:
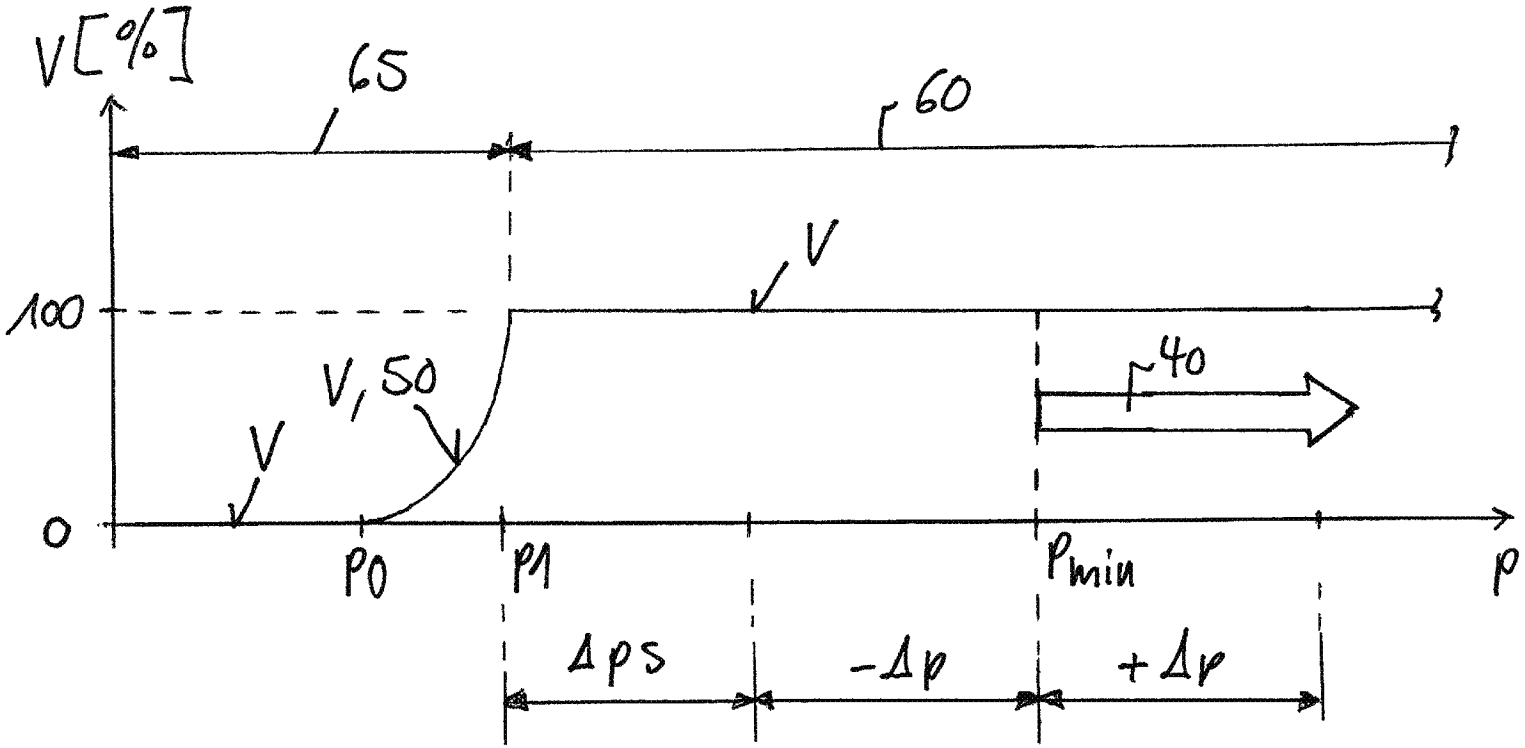
FIG. 3 is a diagram showing the pressure in a hydraulic line running from the control valve device to the lift cylinder device and the speed of descent of the load handling means, to explain the strategies used to evaluate the pressure by the automated set-down mode.

FIG. 3 shows a diagram with the pressure P measured by the pressure sensor device 30 in the connecting line 18 leading from the control valve device 12 to the lift cylinder device 11 and the lowering speed V of the load handling means 3 with an evaluation strategy for the automated set-down mode carried out by the electronic control device 25. The pressure P in the connecting line 18 is plotted on the abscissa in FIG. 3 and the lowering speed V of the load handling means 3 on the ordinate.

A pressure limiting value P1 for the pressure P is stored in the electronic control device 25. A minimum pressure Pmin is also stored in the electronic control device 25 as it is generated in the connecting line 18 if a certain minimum load is being carried on the load handling means 3. Also stored in the electronic control device 25 is an unloaded pressure P0, which results in the connecting line 18 when no load is being carried on the load handling means 3 (i.e. load handling means 3 without a load). FIG. 3 also shows a range that indicates $+\Delta P/-\Delta P$ around the minimum pressure Pmin. The pressure P can fluctuate in the range $+\Delta P/-\Delta P$ around the minimum pressure Pmin during the lowering of the load handling means 3 as a result of oscillations caused by dynamic effects.

The pressure limit value P1 is selected so that it lies between the unloaded pressure P0 and the minimum pressure Pmin. The pressure limiting value P1 is also less by a certain safety margin $\Delta Ps$ than the lower end of the range $-\Delta P$ around the minimum pressure.

The automated set-down mode is then engaged and activated by the electronic control device 25 only if a pressure P is measured in the connecting line 18 that is greater than or equal to the minimum pressure Pmin. This is indicated in FIG. 3 by the arrow 40.

Figure 2A:
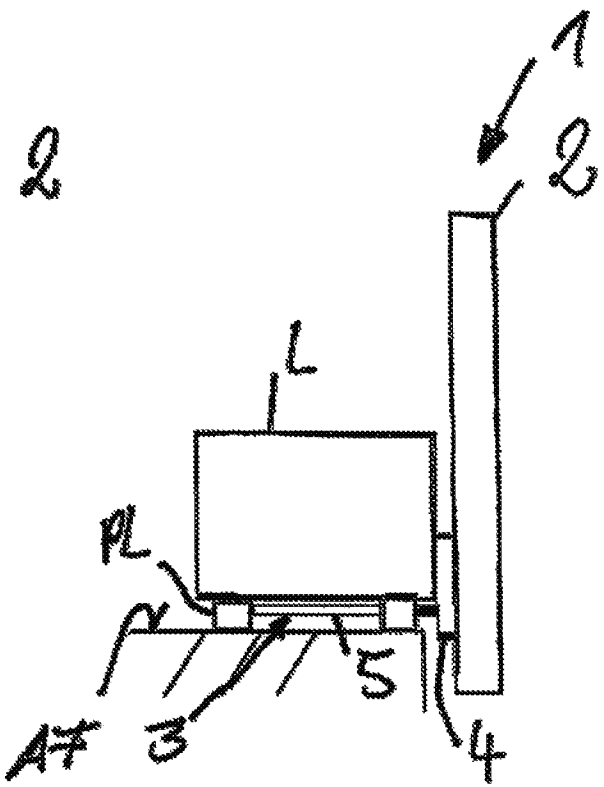
FIGS. 2(*a*) and 2(*b*) are side views illustrating the function of the automated set-down mode with which a load is set down on a designated surface.
Figure 2B:
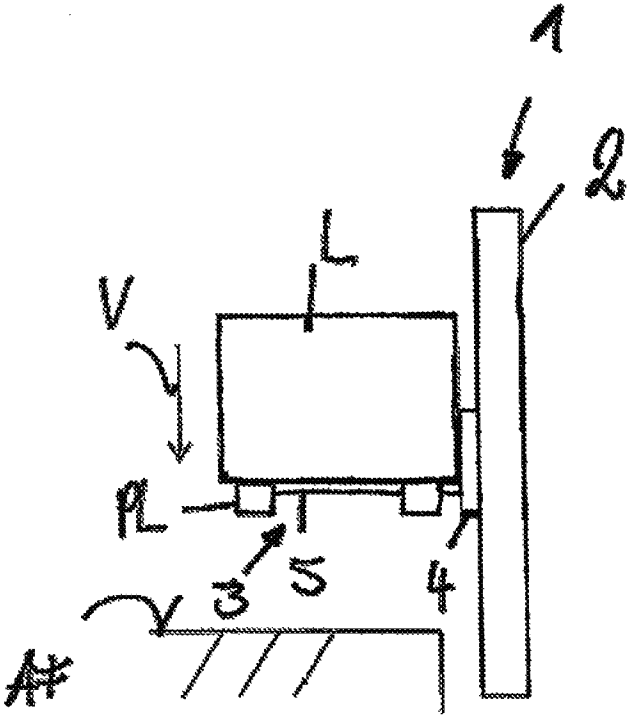

In FIG. 2(*a*), the lowering process of the load handling means 3 with a load L is illustrated. The load L is located on a pallet PL that is being freely carried by the load handling means in the form of the load fork 5. The pallet PL with the load L is to be set down on a designated surface AF. In FIG. 2(*b*), the end of the automated set-down mode in which the pallet PL with the load L is set down on the designated surface AF and the load handling means 3 is stopped before it reaches the designated surface AF, and therefore above the designated surface AF. The designated surface AF can be a compartment of a shelf, the surface of a roadway, or a cargo area of a vehicle.

To set down a load L on the designated surface AF, the operator, by actuating the control element 28 into the lowering position S, specifies a lowering speed V of the load handling means 3, and the control valve device 12 is accordingly actuated by the electronic control device 25 toward the lowering position 13*c*. If the load L generates a pressure P in the connecting line 18 which is greater than or equal to the minimum pressure Pmin, the automated set-down mode is activated by the electronic control device 25.

When the automated set-down process is activated, during a lowering of the load handling means 3, the electronic control device 25 continuously monitors the pressure P in the connecting line 18 by means of the pressure sensor device 30 and evaluates the pressure history of the pressure P. If the measured pressure P is less than the pressure limiting value P1, the electronic control device 25, as the control element 28 continues to be actuated into the lowering position S by the operator, reduces the lowering speed V as indicated by the line 50 in FIG. 3 to zero until the unloaded pressure P0 is reached. In FIG. 3, the curve of the line 50 is exponential, so that the lowering speed V, once it becomes less than the pressure limiting value P1, is reduced exponentially to zero until it reaches the unloaded pressure P0. The control valve device 12 is actuated into the neutral position 13*a* by the electronic control device 25 to reduce the lowering speed V. The pressure limiting value P1 is achieved during the lowering of the load handling means 3 when the pallet PL with the load L is set down on the designated surface AF.

With the automated set-down mode according to the invention, during a lowering of the load handling means 3 and at a pressure P above the pressure limiting value P1, there is no intervention in the lowering speed, and the load handling means 3 is lowered at the lowering speed V specified by the operator by actuating the control element 28 into the lowering position S. In FIG. 3, this range, in which there is no intervention in the lowering speed V, is designated by line 60. If the pressure P during a lowering of the load handling means 3 falls below the pressure limiting value P1, there is an intervention in the lowering speed by means of the automated set-down mode and the lowering of the load handling means 3 as indicated by the line 50 and the load handling means 3 is stopped when the unloaded pressure P0 is reached. In FIG. 3, this range, in which there is an intervention in the lowering speed V, is designated by line 65.

As a result of the automated set-down mode claimed by the invention, during the setting down of a pallet PL with the load L located on it, the load L, as illustrated in FIG. 2(*a*), is set down by the operator, by actuating the control element 28 into the lowering position S at the specified lowering speed V, on the designated surface AF and then the load handling means 3 is automatically stopped by the intervention of the automated set-down mode in the lowering speed V of the load handling means 3, in the illustrated exemplary embodiment the load fork 5, before the load fork 5 reaches the designated surface AF and thus before the load fork 5 is set down on the designated surface AF. The status at the end of the automated set-down process, in which the load fork 5 is stopped before it reaches the designated surface AF, is illustrated in FIG. 2(*b*).

At the end of the automated set-down process, in which the load handling means 3 is automatically stopped as illustrated in FIG. 2(*b*), the operator can drive away without adjusting the height of the load fork 5 and without scraping the load fork 5 on the designated surface AF.

To ensure that the automated set-down mode according to the invention is not erroneously initiated by fluctuations of the pressure P on account of dynamic effects during the lowering of the load handling means 3, the pressure limiting value P1 is lower by the safety margin ΔPs than the range −ΔP around the minimum pressure Pmin. In addition, during the lowering of the load handling means 3, the electronic control device 25 can evaluate whether the pressure P falls from the minimum pressure Pmin to the pressure limiting value P1 within a predetermined length of time, and the automated set-down mode is activated only if, during the lowering of the load handling means 3, the pressure P falls within the predetermined period of time from the minimum pressure Pmin to the pressure limiting value P1. As a result, it is possible to ensure that the lowering process is indeed a process of setting down a load L, during which the automated set-down mode to stop the lowering of the load handling means 3 is to be activated.

At the end of the automated set-down mode, with the load handling means 3 stopped as illustrated in FIG. 2(*b*), the operator, by actuating the control element 28 into the neutral position N and subsequently re-actuating it into the lowering position S, can achieve a further lowering of the load handling means 3.

With the automated set-down mode according to the invention, an automated stop of the lowering of the load handling means 3 can be achieved which is independent of the weight of the load handling means 3 or the weight of the attachment, and is independent of whether a load L is held freely or clamped by the load handling means 3.

The automated set-down mode claimed by the invention works regardless of the lift height of the load handling means 3. As a result of the automated stopping of the descent of the load handling means 3 above the designated surface AF, the load handling means 3 is also protected against wear and the designated surface AF is protected from damage, since, with load handling means 3 in the form of a load fork 5 during the retraction of the load forks 5 out of the pallet PL that has been set down on the designated surface AF, the scraping of the fork tips on the designated surface AF is prevented. With an attachment that clamps the load, for example an attachment in the form of a baler or a roll of paper as the load, the load is protected as it is set down on the designated surface AF with the automated set-down mode claimed by the invention and the automated stop of the lowering of the attachment.

The automated set-down mode claimed by the invention results in a simplified sequence of control operations for the operator of the industrial truck and increased ease of operation when setting down a load L on the designated surface AF, because as a result of the automated stop of the descent of the load handling means 3 above the designated surface AF, after the load L has been set down on the designated surface AF, no further adjustment of the height of the load handling means 3 is necessary to be able to drive the truck away from the load L and the designated surface AF without scraping the load handling means 3. With the automated set-down mode according to the invention, as a result of the automated stopping of the load handling means 3, there is a high level of familiarity for the operator of the industrial truck and a simple operation of the industrial truck when the load L is set down on a designated surface AF, regardless of the lift height, because no intuition or experience on the part of the operator is necessary to position the load handling means L above the designated surface AF.

With the automated set-down mode according to the invention, the industrial truck is equipped with an operator assistance function that leads to reduced fatigue for the operator of the industrial truck and thus to increased safety in the operation of the industrial truck. In addition, the automated set-down mode according to the invention, as a result of the elimination of the need for readjustment of the height of the load handling means 3 when they are extracted from a pallet PL that has been set down on a designated surface AF and a more rapid lowering speed V with which the load is set down on the designated surface AF, makes possible a faster turnover of goods and an increase in the transport capacity of the industrial truck.

The invention is not limited to the illustrated exemplary embodiment of the control valve device 12. Instead of a direct electrical actuation of the control valve device 12 by the actuator devices 20, 21, the control valve device 12 can be actuated electro-hydraulically, in which the actuator devices 20, 21 actuate electrically actuatable setting valves with which a control pressure is generated that actuates the control valve device 12 into the lowering position 13*c* or the raising position 13*b*.

It is also possible to configure the control valve device 12 with separate control valves for raising and lowering operation.

The invention is not restricted to the illustrated embodiment of the lifting frame 2. The lifting frame 2 can be in the form of a multi-section lifting frame, such as a duplex lifting frame or a triplex lifting frame, that has a plurality of lifting stages, for example a free lift of the load handling means 3 and a mast lift with a raising of one or more telescoping masts. On lifting frames 2 of this type, different hydraulic cylinders of the lift cylinder device 11 that are connected with the connecting line 18 are provided for the lifting stages. On a lifting frame 2 of this type, the pressure values Pmin, P1 and P0 can be stored in the electronic control device 25 for each lifting stage of the load handling means 3, and a determination can be made by means of an additional sensor of the lifting stage in which the load handling means 3 is currently located, so that by a corresponding selection of the pressures Pmin, P1 and P0, the automated set-down mode can be executed in each lifting stage of the load handling means 3.

It will be readily appreciated by those skilled in the art that modifications may be made to the invention without departing from the concepts disclosed in the foregoing description. Accordingly, particular embodiments described in detail herein are illustrative only and are not limiting to the scope of the invention, which is to be given the full breadth of the appended claims and any and all equivalents thereof.

The invention claimed is:

1. A lifting device of an industrial truck, comprising:

a load handling arrangement that is raised and lowered on a lifting frame, a hydraulic lift cylinder device that is actuated by an electrically actuatable control valve device for the raising and lowering of the load handling arrangement, an electronic control device that actuates the control valve device, and a pressure sensor device that measures a pressure in a connecting line that leads from the control valve device to the lift cylinder device, wherein the electronic control device has an automated set-down mode in which during a lowering process of the load handling arrangement to set down a load being carried on the load handling arrangement on a designated surface, wherein the control valve device is actuated into a lowering position as a function of a deflection of a control element into a corresponding lowering position, the load is lowered at a lowering speed specified by the deflection of the control element to the designated surface where the load is to be set down, wherein, as the control element continues to be deflected into the lowering position, the lowering process of the load handling arrangement is terminated by the electronic control device by actuating the control valve device into a shut-off position to prevent the load handling arrangement from being set down on the designated surface, wherein the pressure sensor device is in communication with the electronic control device that actuates the control valve device, wherein, during the lowering process of the load handling arrangement, the pressure measured by the pressure sensor device is determined by the electronic control device in the automated set-down mode and the lowering process of the load handling arrangement is terminated by actuating the control valve device into the shut-off position when the pressure measured by the pressure sensor device falls below a specified pressure limiting value, wherein the pressure limiting value lies between an unloaded pressure, which results when the load handling arrangement is not loaded, and a minimum pressure that results when the load handling arrangement is loaded with a minimum load, and wherein the pressure limiting value is lower by a safety margin than a range generated by oscillations around the minimum pressure.

2. The lifting device as recited in claim 1, wherein, during the automated set-down mode, the control valve device is actuated by the electronic control device into the shut-off position, so that the lowering speed of the load handling arrangement is reduced linearly or exponentially to zero, beginning at the pressure limiting value and continuing until the unloaded pressure is reached.

3. The lifting device as recited in claim 1, wherein the automated set-down mode is activated by the electronic control device when the pressure measured by the pressure sensor device at least equals the minimum pressure.

4. The lifting device as recited in claim 1, wherein, during a lowering process, the automated set-down mode is activated by the electronic control device only when the pressure measured by the pressure sensor device falls from the minimum pressure to the pressure limiting value within a specified period of time.

5. The lifting device as recited in claim 1, wherein, by an actuation of the control element into a neutral position and subsequent repeated actuation of the control element into the lowering position, a further lowering of the load handling arrangement is achieved by an actuation of the control valve device into the lowering position.

6. The lifting device as recited in claim 1, wherein the lifting frame is in the form of a multi-section lifting frame with at least two lifting stages, wherein the electronic control device is operationally connected with a sensor device that determines the lifting stage in which the load handling arrangement is currently located.

7. The lifting device as recited in claim 1, wherein the unloaded pressure, the minimum pressure, the pressure limiting value, or the unloaded pressure, the minimum pressure, and the pressure limiting value are configured to be set and varied.

8. The lifting device as recited in claim 1, wherein the control valve device is in the form of a control valve with the lowering position and a shut-off position that is actuated by an electrical actuator device toward the lowering position.

9. The lifting device as recited in claim 1, wherein the control valve device is in the form of a control valve with a raising position, the lowering position, and a shut-off position in the form of a neutral position, which is activated by an electrical actuator device toward the lowering position and by an additional actuator device toward the raising position.

10. The lifting device as recited in claim 1, wherein, for the actuation of the control valve device into a shut-off position when the pressure in the connecting line is below a pressure limiting value, the actuation of the control valve device into the lowering position is terminated by the electronic control device.

11. A method for setting down a load located on a load handling arrangement of an industrial truck on a designated surface, wherein the load handling arrangement is located so that the load handling arrangement is raised and lowered on a lifting frame of the industrial truck, and a hydraulic lift cylinder device is provided that is actuated by an electrically actuated control valve device to raise and lower the load handling arrangement, the method comprising:

actuating the control valve device into a lowering position as a function of a deflection of a control element into a corresponding lowering position, lowering the load to the designated surface on which the load is to be set down at a lowering speed specified by the deflection of the control element, as the load located on the load handling arrangement of the industrial truck is being set down on the designated surface, continuously measuring a pressure in a connecting line leading from the control valve device to the lift cylinder device and terminating the lowering process of the load handling arrangement by actuating the control valve device into the shut-off position when the measured pressure is below a specified pressure limiting value, and as the control element continues to be deflected into the lowering position, terminating the lowering process of the load handling arrangement by actuation of the control valve device into a shut-off position, to prevent the load handling arrangement from being set down on the designated surface, wherein the pressure limiting value lies between an unloaded pressure, which results when the load handling arrangement is not loaded, and a minimum pressure that results from the load handling arrangement carrying a minimum load, and wherein the pressure limiting value is lower by a safety margin than a range around the minimum pressure generated by oscillations.

12. The method as recited in claim 11, further comprising actuating the control valve device into the shut-off position when the load located on the load handling arrangement of the industrial truck is being set down on the designated surface so that the lowering speed of the load handling arrangement is reduced linearly or exponentially to zero starting when the pressure falls below the pressure limiting value until the pressure reaches the unloaded pressure.

13. The method as recited in claim 11, further comprising activating the setting down of the load located on the load handling arrangement of the industrial truck on the designated surface when the pressure measured at least equals the minimum pressure.

14. The method as recited in claim 11, further comprising, during a lowering process, activating the setting down of the load being carried on the load handling arrangement of the industrial truck on the designated surface only when the measured pressure drops from the minimum pressure to the pressure limiting value within a specified period of time.

15. The method as recited in claim 11, wherein a further lowering of the load handling arrangement by an actuation of the control valve device into the lowering position is achieved by actuating the control element into a neutral position and subsequent repeated actuation of the control element into the lowering position.

16. The method as recited in claim 11, wherein the lifting frame is in the form of a multi-section lifting frame with at least two lifting stages, whereby a sensor device determines in which lifting stage the load handling arrangement is located.

17. The method as recited in claim 11, wherein the unloaded pressure, the minimum pressure, the pressure limiting value, or the unloaded pressure, the minimum pressure, and the pressure limiting value are configured to be set and varied.

* * * * *